United States Patent [19]

Teteishi et al.

[11] Patent Number: 4,860,523

[45] Date of Patent: Aug. 29, 1989

[54] HERMETIC PACKAGING APPARATUS

[75] Inventors: Iwao Teteishi, Nara; Yoshiyuki Ogura; Takeshi Hashimoto, both of Osaka; Tuguyoshi Ritou, Nara; Katsufumi Kajiyama, Osaka; Fumiaki Shimizu, Nara; Kenji Tanaka, Osaka; Yutaka Aibara, Osaka; Hiroaki Kataoka, Osaka; Katsuya Nakai, Osaka; Takashi Yoshikawa, Osaka; Masaaki Kanamori, Nagano; Masao Miyajima, Nagano; Shuzo Seki, Nagano; Sadanobu Takahashi, Nagano, all of Japan

[73] Assignees: Sharp Kabushiki Kaisha, Osaka; Nihon Dennetsu Co., Ltd., Tokyo, both of Japan

[21] Appl. No.: 114,603

[22] Filed: Oct. 30, 1987

[30] Foreign Application Priority Data

| | | | |
|---|---|---|---|
| Oct. 31, 1986 | [JP] | Japan | 61-261076 |
| Dec. 19, 1986 | [JP] | Japan | 61-304931 |
| Dec. 22, 1986 | [JP] | Japan | 61-306124 |
| Dec. 22, 1986 | [JP] | Japan | 61-306125 |

[51] Int. Cl.[4] ..... B65B 31/06; B65B 67/00

[52] U.S. Cl. ..... 53/512; 53/390

[58] Field of Search ..... 53/434, 88, 312, 373, 53/390, 570, 266 R

[56] References Cited

U.S. PATENT DOCUMENTS

| | | | |
|---|---|---|---|
| 2,838,894 | 6/1958 | Paikens et al. | 53/512 X |
| 2,963,838 | 12/1960 | Harrison et al. | 53/512 X |
| 3,304,687 | 2/1967 | Tomczak et al. | 53/512 X |
| 3,376,690 | 4/1968 | Jianas | 53/512 |
| 3,516,223 | 6/1970 | Andersen et al. | 53/512 |
| 3,589,098 | 6/1971 | Schainholtz | 53/512 |
| 3,630,665 | 12/1971 | Andersen et al. | 53/434 X |
| 4,330,975 | 5/1982 | Kakiuchi | 53/512 X |
| 4,561,925 | 12/1985 | Skerjanec et al. | 53/512 X |

FOREIGN PATENT DOCUMENTS 54-38959 11/1979 Japan .

*Primary Examiner*—Horace M. Culver

*Attorney, Agent, or Firm*—Birch, Stewart, Kolasch & Birch

[57] ABSTRACT

The hermetic packaging apparatus comprises a nozzle for reducing pressure in a thermoplastic packaging bag containing certain contents, the nozzle reduces pressure in the packaging bag by the pressure control of the air pump and the water sucked from the contents is directed to a strainer tank. Thereafter, the nozzle moves backward, the opening of the packaging bag is heated by a heating element, and an airtight pressure connecting bar is pressured downward so that the opening portion is heat-sealed by the airtight pressure connecting bar and the sealing base.

17 Claims, 15 Drawing Sheets

FIG.8
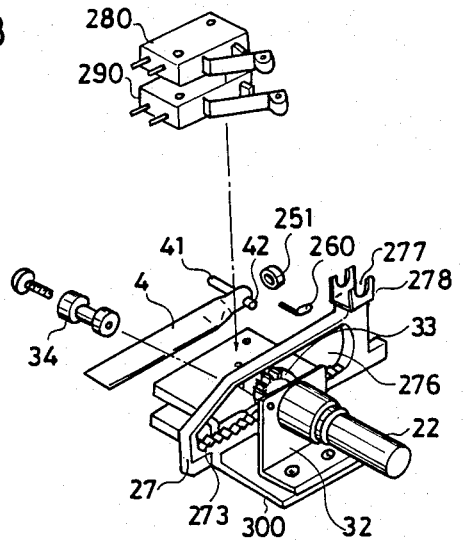
FIG.13A
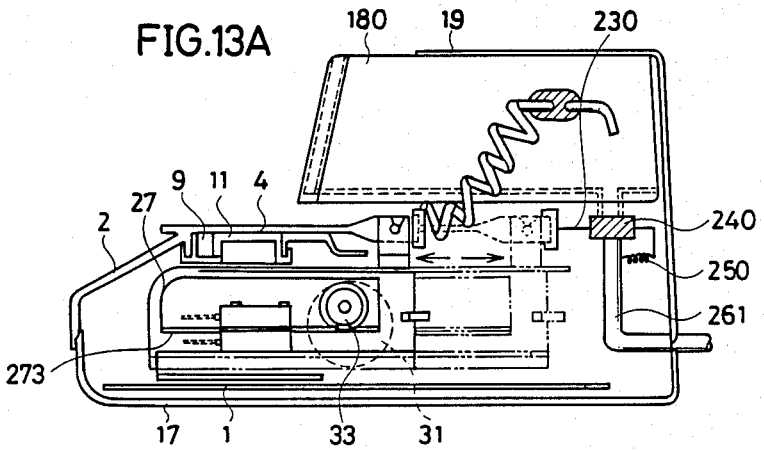
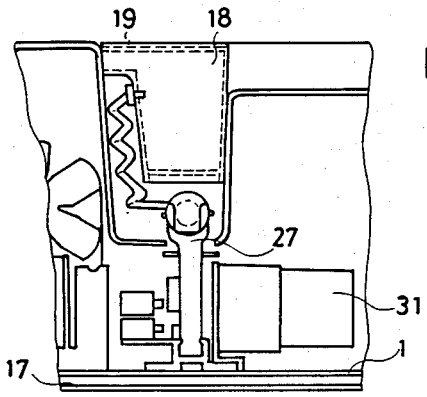
FIG.13B

HERMETIC PACKAGING APPARATUS

BACKGROUND OF THE INVENTION

1. Field of the Invention

The present invention relates to a hermetic packaging apparatus. More specifically, the present invention relates to a hermetic packaging apparatus in which the pressure in a thermoplastic packaging bag is reduced or increased or the packaging bag is filled with an inert gas and thereafter the opening of the packaging bag is heat-sealed by a heating material.

2. Description of the Prior Art

FIG. 1 is an outward perspective view of a conventional hermetic packaging apparatus and FIG. 2 is a cross sectional view of the same.

A conventional hermetic packaging apparatus will be described with reference to FIGS. 1 and 2. A power supply transformer, an air pump, a pressurizing link mechanism, a nozzle mechanism portion and so on are mounted on a metal base plate 1, though not shown. A top cover 2 covers the base plate 1 mounting these components from above and the cover is fixed to the base plate 1 by screws 10. An operation panel 3 having switches, adjustment handles, indicating lamps and so on necessary for operation is provided on the top cover 2. A nozzle 4 for deaeration, introducing air or for filling a bag with gas is provided such that it protrudes forward from the top cover 2 and this nozzle 4 is movable in forward and backward directions by a nozzle operating lever 5 protruding upward from the top cover 2.

In addition, a sealing base 11, an airtight packing 9 and a heating element 8 such as a heating wire are fixed below the nozzle 4 and in front of the top cover 2. An airtight pressure connecting bar 6, an airtight packing 7 and a seal packing 12 are provided and are movable in upward and downward directions by a link mechanism, not shown, above the nozzle 4 such that they are opposed to the sealing base 11. A table 14 is fixed to the sealing base 11 with screws 13. In hermetically sealing contents 16 in a package bag 15 using the hermetic packaging apparatus structured as above, a nozzle operating lever 5 is first pulled this side as shown in FIG. 2 so that the nozzle 4 protrudes on this side of the airtight packings 7 and 9. Then, the opening of the packaging bag 15 containing the contents 16 is put on the tip end of the nozzle 4 so as to cover the tip end with the bag, the nozzle 4 is surrounded by the packaging bag 15 and the opening end is inserted to the inner part of the sealing base 11.

Thereafter, the airtight pressure connecting bar 6 is pushed downward and the vicinity of the opening of the packaging bag 15 is held in an airtight condition by airtight packings 7 and 9 through the flat tube portion of the nozzle 4. Next, air in the packaging bag 15 is sucked and exhausted from the tip end of the nozzle 4 by means of a vacuum pump (not shown) or the like connected to the nozzle 4. When a package is to be filled with gas, gas is introduced on this occasion.

Then, the nozzle operating lever 5 is pulled backward rapidly, the nozzle 4 is extracted from the opening of the packaging bag 15 and, simultaneously, the airtight pressure connecting bar 6 is pushed further downward to connect the packaging bag 15 by the airtight pressure connecting bar 6 and the sealing table 11. In this state, a heating element 8 provided on the top side of the sealing base 11 is heated and the vicinity of the opening of the packaging bag 15 are connected by heat welding. After the heating, heat-sealing is accomplished after an appropriate time for cooling.

Other than the hermetic packaging apparatus structured as above, hermetic packaging apparatuses are known from Japanese Patent Publication Gazette No. 38959/1979 and U.S. Pat. No. 3,589,098.

In a conventional hermetic packaging apparatus as described above, the base plate 1, airtight pressure connecting bar 6, nozzle 4, screws 10 and 13 and so on, which are the portions easily accessed, are formed of metals. Therefore, if an insufficient insulation occurs due to some cause in the electric parts such as power supply transformer, air pump and so on, there is a possible danger of the metal portions becoming electric charging portions.

Meanwhile, some contents include a lot of water and others may be powder. The repeated sucking of such water and powder may cause a jam of powder or the like in the nozzle 4, air pump, strainer and an airtight pipe connecting these portions, causing a failure, a nasty smell, or the reproduction of various germs.

In addition, the contents 16 in the packaging bag 15 may be spilt on the base plate 1 by accident during operation. In such case, if the content 16 is a broth including salt, for example, the broth enters from the front opening A of the top cover 2 affecting the electric parts of the apparatus.

In the conventional hermetic packaging apparatus, the nozzle operating lever 5 should be pulled to this side and after the decompression, pressurization or the filling of the packaging bag 15 with gas, the nozzle operating lever 5 should be again pulled backward manually every time the content 16 is packed in the packaging bag 15. It is troublesome to operate the nozzle operating lever 5 every time. In addition, the nozzle operating lever 5 must be rapidly operated after the decompression, pressurization or filling with gas in order to hold the airtightness.

Furthermore, the strainer tank must be removed or the plug provided in the strainer tank must be removed after several operations, in order to dispose of the stagnant liquid in the strainer tank.

In the above described conventional hermetic packaging apparatus, the contents 16 in the packaging bag 15 may be shifted during heat-sealing, so that the contents 16 can not be sealed easily. As for the contents including water, the water is sucked by the nozzle 4 into the pump.

SUMMARY OF THE INVENTION

Therefore, a main object of the present invention is to provide a hermetic packaging apparatus having an inner electric part covered with a resin cover, which is an electric insulating material, for enabling safe and sanitary operation.

Another aspect of the present invention is to provide a hermetic packaging apparatus in which the pulling in and out of the nozzle is carried out automatically and the nozzle can be smoothly drawn after reducing or increasing pressure, or filling with the gas at good timing.

A further aspect of the present invention is to provide a hermetic packaging apparatus in which, in reducing pressure in the packaging bag containing a content including water, sucked liquid can be temporarily kept in a strainer tank and can be disposed externally at every operation.

A further aspect of the present invention is to provide a hermetic packaging apparatus in which the possibility of water sucked by the nozzle into the pump is eliminated by making the height of the work table adjustable in upward and downward directions.

Briefly stated, the present invention is a hermetic packaging apparatus comprising a nozzle for reducing or increasing pressure in a packaging bag or for filling the bag with gas, pressure control means for reducing pressure, increasing pressure or keeping a prescribed gas pressure in the packaging bag, heat-sealing means for heat-sealing the opening of the packaging bag with heat provided on a metal base and a resin cover constituting a casing.

Therefore, according to the present invention, since inner electric parts such as pressure control means are covered by a resin cover, which is an electric insulating material, the hermetic material can be operated safely and sanitarily.

In a preferred embodiment of the present invention, a nozzle holding means holds a nozzle and the nozzle holding means is moved forward and backward in response to an external instruction.

Therefore, according to the preferred embodiment of the present invention, taking in and out of the nozzle can be carried out automatically in response to the external instruction so that the nozzle can be drawn smoothly after reducing pressure, increasing pressure or filling a bag with the gas.

In a more preferred embodiment of the present invention, in reducing pressure of the packaging bag by the nozzle, the liquid sucked from the contents is stored in a waste water storage means and, after the suction of the packaging bag, the waste water stored in the waste water storage means is discharged corresponding to the backward movement of the nozzle.

Therefore, according to the more preferred embodiment of the present invention, the waste water stored in the waste water storage means can be disposed of every time the opening of the packaging bag is heat-sealed. Therefore, successive hermetic packaging can be carried out on the contents including a lot of water. In addition, reproduction of the various germs in the waste water storage means can be prevented.

According to a more preferred embodiment of the present invention, a working table is detachably provided in front of the metal base plate and the fore-leg of the working table is collapsible.

Therefore, according to the more preferred embodiment of the present invention, when the contents including water are placed on the working table in a packaging bag with the fore-leg of the working table folded, so that the table has an inclined surface, water flows backward in the packaging bag, and one can operate without spilling liquid from the packaging bag. Contents having little water can be packed evenly by setting the working table flat.

These objects and other objects, features, aspects and advantages of the present invention will become more apparent from the following detailed description of the present invention when taken in conjunction with the accompanying drawings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 8 is an exploded perspective view of the nozzle mechanism;

FIG. 13A is a cross sectional view of a hermetic package apparatus having an improved strainer and FIG. 13B is a rear view of the main portion thereof;

DESCRIPTION OF THE PREFERRED EMBODIMENTS

Figure 3:
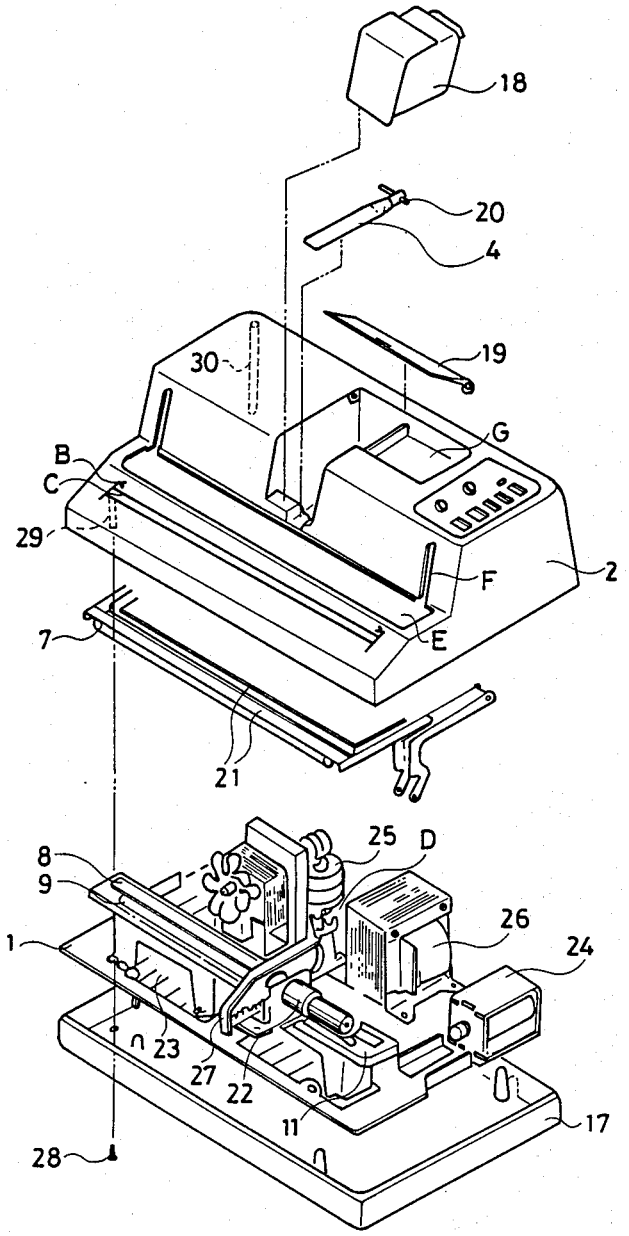
FIG. 3 is an exploded perspective view of one embodiment of the present invention.
Figure 4:
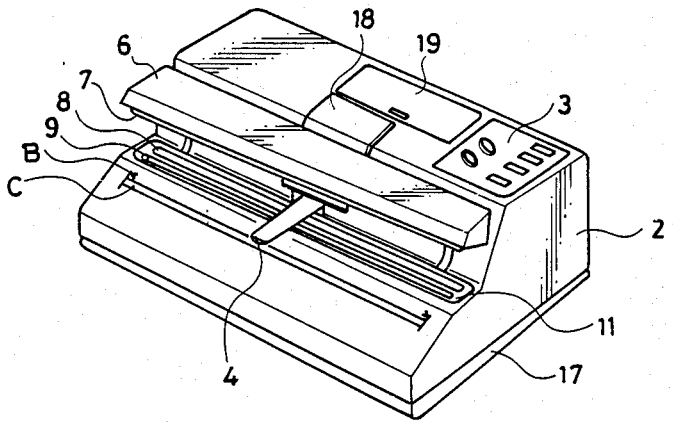
FIG. 4 is an outward view of one embodiment of the present invention.

FIG. 3 is an exploded perspective view of one embodiment of the present invention and FIG. 4 is an outer view of one embodiment of the present invention.

The structure of one embodiment of the present invention will be hereinafter described with reference to FIGS. 3 and 4. As shown in FIG. 4, the whole apparatus is covered with a resin top cover 2 and a resin bottom cover 17 and an airtight pressure connecting bar 6 and an airtight packing 7 are provided in the front portion of the top cover 2 as in the conventional apparatus. That portion of the top cover 2 which is opposed to the airtight pressure connecting bar 6 is formed flat and the front side thereof is formed with an inclination. In the flat portion of the top cover 2, a sealing base 11, heating material 8 and an airtight packing 9 are contained opposing to the airtight pressure connecting bar 6. A stainless nozzle 4 is provided between the airtight pressure connecting bar 6 and the sealing base 11 such that it protrudes from the strainer 18. The strainer 18 stores the water when the nozzle 4 sucks the water in the packaging bag 15.

On the top portion of the top cover 2, an operating panel 3 as well as a lid 19 are provided. A space for keeping little consumables such as heater for the heating material 8, Teflon (Registered Trade Mark) tape and so on is provided in the lid 19. In addition, on the front inclined surface of the top cover, an indication B showing the sealable range of the apparatus and a contents reference line C. The contents reference line C shows a reference position for setting the contents 16 to reduce the failure of suction and successfully carry out suction when the contents 16 are put in the packaging bag 15 and set on the nozzle 4.

As described above, the outer casing which can be easily accessed are all formed of resin materials which are an insulator, and the metal parts, namely, the stainless nozzle 4 and the aluminum sealing base 11 are electrically insulated from other electrical parts and from a metal base plate described later in the apparatus whereby all outer surfaces are electrically insulated, providing a highly safe structure. As for the operational and functional convenience, the strainer 18 is provided in the central portion of the front side of the body, so that the inside of the strainer 18 can be naturally seen while the apparatus is being operated.

Since the hermetic packaging apparatus according to one embodiment of the present invention is mainly used for hermetic packaging of foods, the apparatus should always be kept clean. From this point of view, this apparatus is well devised as will be described by the following. Namely, the nozzle 4, strainer 18 and the connection pipe connecting these are detachable, and they can be easily removed enabling washing and cleaning thereof.

The inner structure of one embodiment of the present invention will be hereinafter described in detail with reference to FIG. 3. Referring to FIG. 3, there are provided on the metal base plate 1, a sealing base 11 insulated by an insulating material 23, a nozzle motor 22 for moving the nozzle 4 in the forward and backward directions, a solenoid 24 for applying pressure on the airtight packing and the sealing surface by pulling the airtight pressure connecting bar 6 downward, an air pump 25 for evacuating or for introducing air in the packaging bag 15, a power supply transformer for supplying a constant voltage to the heating material 8 and the control circuit, and so on. These parts are charging parts and heat generating elements whose temperatures are raised as the apparatus is operated.

The power supply transformer 26 and the air pump 25 have a rather large weight and a lot of power is exerted on the sealing base 11, solenoid 24 and the accompanying pressurizing mechanism (not shown). Therefore, the base plate 1 must have rigidity and heat resistance. In order to fulfill these conditions, in one embodiment of the present invention, the base plate 1 is formed of a metal plate with drilling and bending carried out by pressing so that all functional parts can be mounted thereon.

The functional units formed on the base plate 1 can be operated without the bottom cover 17 and the top cover 2, so that the processing inspection such as confirmation of operation can be carried out during the assembling process. In addition, the resin top cover 2 and the bottom cover 17 may be assembled in the last processing step, so that the disadvantages such as damage to the outward parts during processing can be minimized.

The aperture E is simultaneously formed with the top cover 2 by a metal mold, in which a large rectangular portion fits on the sealing base 11 and it is large enough to have the pressurizing arm 21 before the attachment of the resin airtight pressure connecting bar 6 pass smoothly when the top cover 2 is attached to the function unit. Two notches F are provided as through-holes for the pressurizing arm 21.

The container portion of the strainer 18 is nearly U shape allowing one to take out the strainer 18 upwardly. It is considered in designing that the outward surface of the top cover 2 and the strainer 18 match to each other. In addition, fitting portions are provided in the top cover 2 and the strainer 18 so that the strainer 18 could only be pushed downward from above to be set in the normal attachment position.

The attachment portion of the nozzle 4 is formed to be a nearly U shape trench and the nozzle 4 is taken out upwardly after the strainer 18 is removed. Therefore, it is not troublesome such as the case in which the nozzle 4 is attached and removed through a hole. A pocket G is provided to keep little consumables such as heater for the heating portion 8 and a Teflon tape. Loss of little parts can be prevented and they can be used off hand if necessary.

The assembling process of one embodiment of the present invention will be hereinafter described. Various functional parts are mounted on the base plate 1, confirmation of operation as a functional unit is carried out, the functional unit is fixed to the bottom cover 17 by screws or the like, a top cover 2 is put on from above and the screws 28 are fastened with the insert molded boss 29 and 30 of the top cover 2 from the rear side of the bottom cover 17. Then a nozzle supporting pipe 20 is fitted in the nozzle support portion D of the nozzle base 27 and a coupling pipe (not shown) is attached. Then, the strainer 18 is pushed from above to be mounted on the prescribed position on the top cover 2, the strainer cap (not shown) or the like is connected, and the lid 19 is fitted in the support hole of the top cover 2 and the switch buttons or volume buttons on the operating panel 3 are attached and thus the assembly is completed.

Meanwhile, in evacuating the air in the packaging bag 15 with a liquid or powder in the bag 15, if the contents are sucked too much by accident, there is a possibility that the contents may enter the air pump 25. This may stain or damage the inner part of the air pump 25. If the accidental suction is noticed immediately, the pressure reducing operation can be stopped. Therefore, in one embodiment of the present invention, the strainer 18 is structured such that if liquid or powder is sucked by accident, it is noticed immediately, and if sucked, the sucked contents can be gathered so as not to cause problems with the air pump 25 or the like. Such a strainer 18 will be described in detail in the following.

Figure 5:
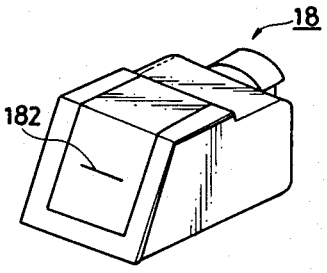
FIGS. 5 and 6 are outward perspective views of a strainer.
Figure 6:
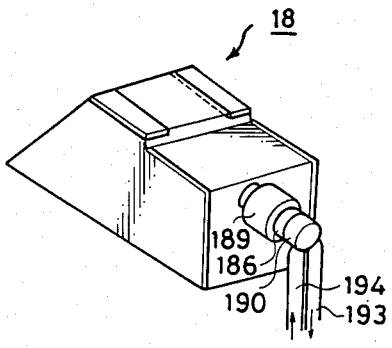
Figure 7:
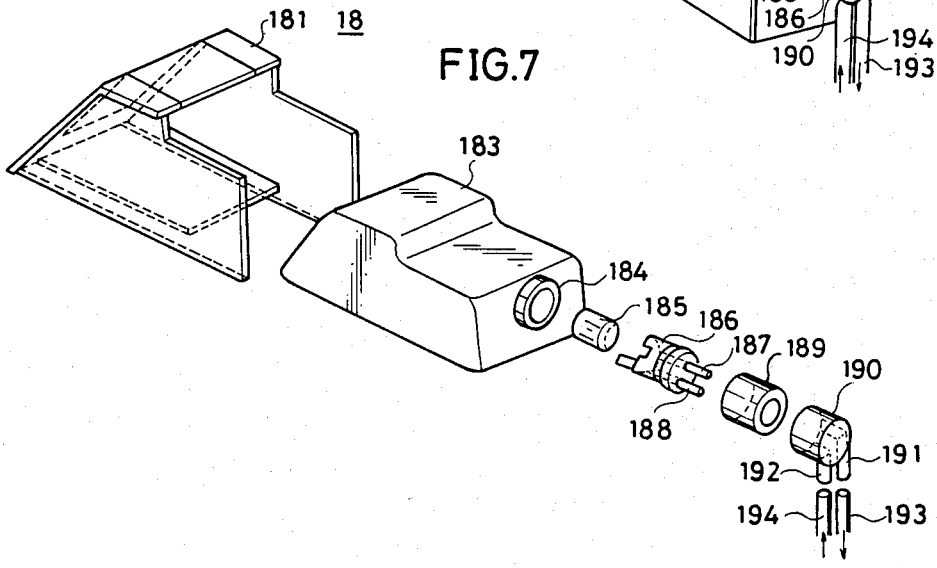
FIG. 7 is an exploded perspective view of the strainer.

FIGS. 5 and 6 are outward perspective views of the strainer and FIG. 7 is an exploded perspective view of the strainer.

The strainer 18 comprises a strainer tank 183 and a strainer cover 181 covering the strainer tank 183. Since the strainer tank 183 is formed of a transparent or translucent resin, accidental suction of liquid or powder can be noticed immediately. In addition, the strainer tank 183 is detachable, so that it can be removed and washed to always be kept sanitary. In addition, an overflow line 182 is marked on the front surface of the strainer cover 181 allowing easy confirmation of high water level of the strainer tank 183.

A tank hole 184 is formed on the rear side in the strainer tank 183 and a filter case 186 containing a filter 185 is attached thereto. The filter 185 prevents powder or the like from entering the strainer tank 183. A suction pipe 188 and an exhaust pipe 187 are provided in the filter case 186 and the suction pipe 188 and an exhaust pipe 187 are coupled to a pipe joint 190 through a tank cap 189. In the pipe joint 190, a suction joint 192 and an exhaust joint 191, are provided. The suction joint 191 couples the suction pipe 188 of the filter case 186 to the external suction pipe 194 and the exhaust joint 191 couples the exhaust pipe 187 of the filter case 186 to the external exhaust pipe 193. The suction pipe 194 is coupled to the nozzle 4 shown in the above described FIGS. 3 and 4.

By structuring the strainer 18 as described above, the air in the packaging bag 15 flows through the nozzle 4, suction pipe 194, suction joint 192, suction pipe 188 to the strainer tank 183. The air in the strainer tank 183 passes through the filter 185, exhaust pipe 187, exhaust joint 191 and exhaust pipe 193 to be discharged outside.

As described above, according to one embodiment of the present invention, if liquid or powder is sucked by accident, it can be seen immediately by looking at the strainer tank 183 when reducing pressure in the packaging bag 15 containing liquid or powder. Since an overflow line 182 is marked on the strainer cover 181, the high water level can be easily confirmed and powder or the like can be gathered in the strainer tank 183 through the filter 185. Since the strainer tank 183 is detachable, it can be easily washed to be kept in a sanitary condition.

Figure 9B:
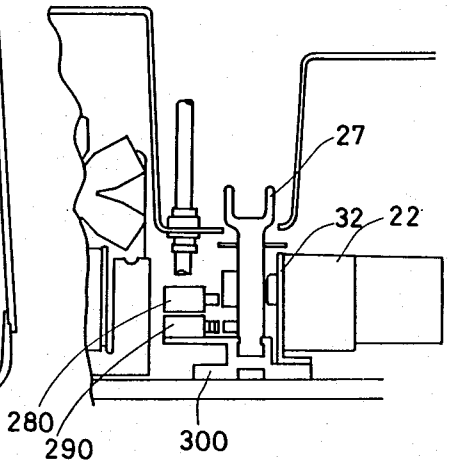
FIG. 9A is a cross sectional side view of the nozzle mechanism and FIG. 9B is a longitudinal cross sectional view of a main portion thereof viewed from the rear.
Figure 9A:
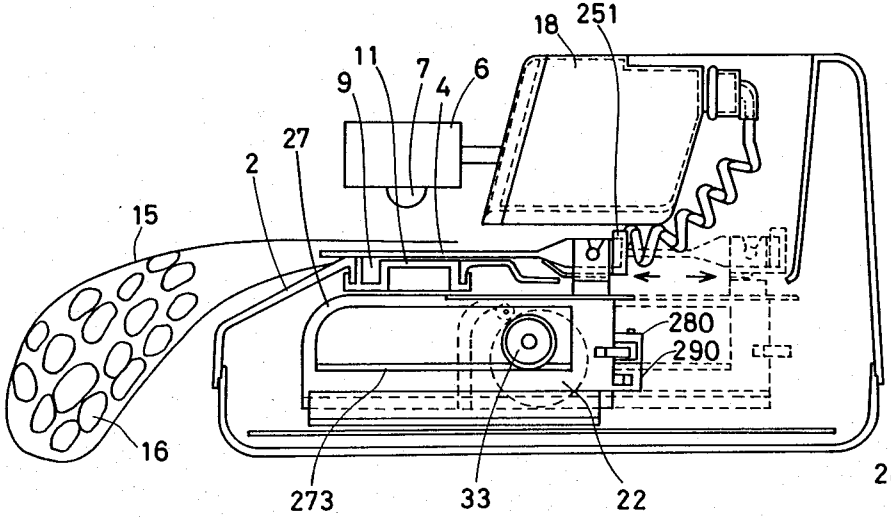
Figure 10B:
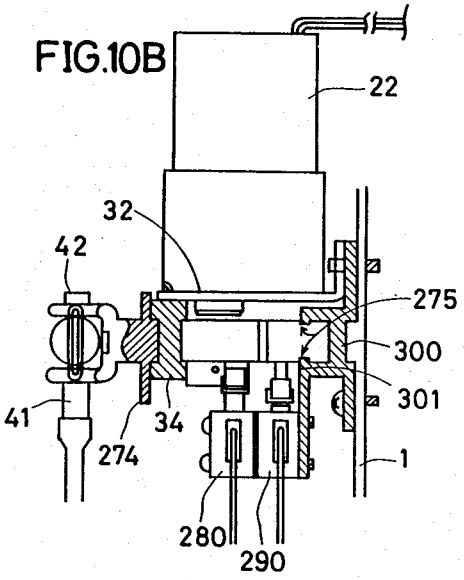
FIG. 10B is a rear view of the same and FIG. 10C is a side view of the same.
Figure 10A:
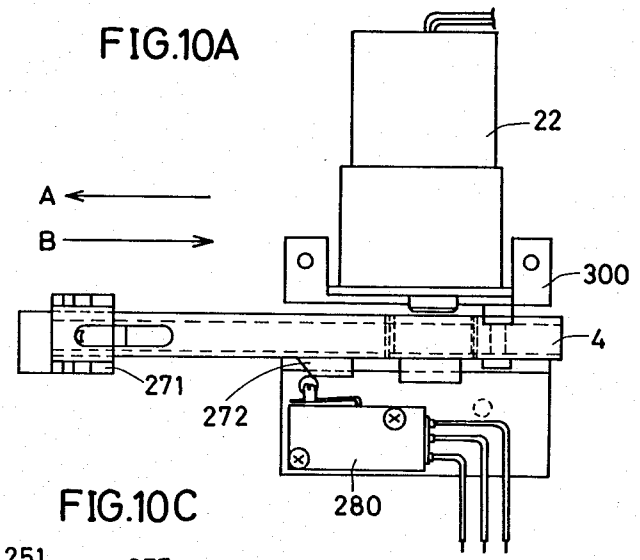
FIG. 10A is a plan view showing the nozzle mechanism in detail.
Figure 10C:
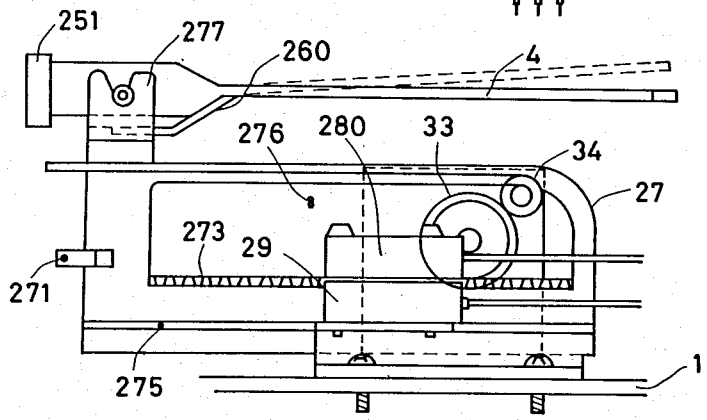

FIG. 8 is an exploded perspective view of the nozzle mechanism according to one embodiment of the present invention, FIG. 9A is a cross sectional view of the nozzle mechanism and FIG. 9B is a cross sectional view from the rear side of the nozzle mechanism. FIG. 10A is a plan view showing the structure of the nozzle mechanism in detail, FIG. 10B is a rear view and FIG. 10C is a side view of the same.

The structure of the nozzle mechanism will be described with reference to FIGS. 8 to 10C. In the central portion of the body shown in FIG. 3, a nozzle mechanism as shown in FIG. 8 is contained. The nozzle 4 is provided such that it protrudes externally from almost the central portion of the front side of the top cover 2. The nozzle 4 is automatically movable in the forward and backward direction through the nozzle mechanism shown in FIG. 8.

The nozzle mechanism will be described in detail with reference to FIG. 8. The tip portion of the nozzle 4 is formed flat in order to reduce leakage as much as possible at the time of taking it in and out of the packaging bag 15, reducing pressure, increasing pressure or filling gas. The rear portion of the nozzle 4 is opened for cleaning and a cap 251 is fitted in that portion in order prevent the decompressed air or the like from leaking. Pipes 41 and 42 are provided on the back side of the nozzle 4 protruding in right and left directions. One pipe 41 is connected to a pump, not shown, and the other pipe 42 is sealed.

This nozzle 4 is held by a nozzle base 27. Namely, a U shaped projection 278 is formed in the rear portion of the nozzle base 27 and the pipes 41 and 42 of the nozzle 4 are fastened to the U shaped projection 278. An aperture 277 having a slightly narrowed inlet is formed in the U shaped projection 278 so that the pipes 41 and 42 of the nozzle 4 cannot easily come out and the pipes 41 and 42 of the nozzle 4 are fitted into the aperture 277 by one snap action. By forming the nozzle base 27 with resin, the pipes 41 and 42 of the nozzle 4 are not easily deformed due to the elasticity of the resin when the pipes are fitted into the aperture 277 of the U shaped projection 278. In addition, a leaf spring 260 is provided on the U shaped projection 278 as shown in FIG. 10C in order to reduce the frictional resistance when the nozzle 4 traverses the seal base 11, heating material 8 and the airtight packing 9. The nozzle 4 is slightly raised by the elasticity of the leaf spring 260.

A cavity 276 is provided in the central portion of the nozzle base 27 and a rack 273 is formed on the lower side thereof. A motor 22 is arranged in the right side viewed from the front side of the nozzle base 27, a spur gear 33 is attached to the rotary axis of the motor 22 and the spur gear 33 is engaged with the rack 273. The motor 22 is attached to a unit base 300 through a motor attaching plate 32. Detection switches 280 and 290 are attached to the unit base 300 on the left side of the nozzle base 27. These detection switches 280 and 290 detect those positions when the nozzle base 27 is most projected and most retracted. Therefore, on the left side surface of the nozzle base 27, there is a projection 271 on which the detection switch 280 abuts when the nozzle base 27 is most projected and there is a projection 272 on which the detection switch 290 abuts when the nozzle base 27 is most retracted, as shown in FIG. 10A.

A guiding axis 34 is arranged such that it touches the lower surface of the upper portion of the nozzle base 27. This guiding axis 34 prevents the swing of the nozzle base 27 in the left and right direction. A trench 275 is formed in the lower portion of the nozzle base 27 as shown in FIG. 10C, and a projection 301 of the unit base 300 is fitted in the trench 275 as shown in FIG. 10B. This prevents the swing of the nozzle base 27 up and down. As described above, by structuring the nozzle base 27 by molding resin, the number of parts are reduced, the dimensions are made precise and the assembling process is made simple, thereby lowering the costs.

Each of the parts structured as above are attached to the unit base 300 to be mounted on the base plate 1 of the body. Consequently, the exchange of the units is possible thereby increasing the reliability of the parts, confirming the certainty of the operation and facilitating the exchange and assembly.

The operation will be hereinafter described. Referring to FIG. 10A, in the stand-by state before operating, the nozzle 4 is extended to the B direction. On this state, the content 16 is putted in the packaging bag 15, the opening portion of the packaging bag 15 is positioned above and below the nozzle 4 and it is mounted on the sealing base 11. When the power switch is turned on and the airtight pressure connecting bar 6 is pushed downward, the opening portion of the packaging bag 15 is sealed and the airtight pressure connecting bar 6 is held by a solenoid (not shown). On this occasion, the detection switch 280 abuts to the projection 271 of the nozzle base 27, detecting that the nozzle 4 is extended to the furthest position.

In response to the detected output, the pump is activated by a microcomputer, not shown, beginning the reducing of pressure, pressurizing or filling of the packaging bag 15 with gas. At the time when the inner pressure of the packaging bag 15 becomes uniform, a driving signal is applied to the motor 22 and the motor 22 rotates. Corresponding to the rotation of the motor 22, the rotating power of the spur gear 33 is transmitted to the rack 273 of the nozzle base 27 and the nozzle base 27 moves in the A direction. Consequently, the nozzle 4 comes out from the opening portion of the packaging bag 15 and the projection 272 of the nozzle base 27 abuts the detection switch 290. When the detection signal of the detection switch 290 is applied to the microcomputer, a stop signal is applied to the motor 22 stopping the rotation of the motor 22.

After a prescribed time period, the pump is stopped, the airtight pressure connecting bar 6 again presses the packaging bag 15 on the sealing base 11 and the opening of the packaging bag 15 is heated by a heating material 8 to be heat-sealed. Next, the solenoid which has held the airtight pressure connecting bar 6 is deenergized and the airtight pressure connecting bar 6 is raised upward by a spring 260. Thereafter, a reverse rotation signal in the A direction is applied to the motor 22, the motor 22 rotates in the reverse direction and the nozzle base 27 is extended in that A direction. The projection 271 of the nozzle base 27 again abuts the detection switch 280 and the microcomputer stops the motor 22 in response to the detection signal of the detection switch 280.

Meanwhile, when the nozzle 4 moves forward and backward, there are many obstacles. Since the tip end of the nozzle 4 is slightly raised by the spring 260 in order to move the nozzle 4 smoothly, the nozzle 4 can be moved smoothly without striking against obstacles.

As described above, according to this embodiment, since extending and retracting operation of the nozzle 4 is not carried out manually as in the conventional device, but by the driving power of the motor 22, the operation for extending and retraction the nozzle 4 every time when sealing the packaging bag 15 can be omitted, thereby improving the operation efficiency. In addition, since the nozzle base 27 is processed by solid molding, the structure can be simplified, reducing the number of parts. In addition, since the nozzle base 27 has an integral construction, the dimension accuracy is maintained and the reliability of parts can be enhanced. The extending operation of the nozzle 4 is carried out automatically, so that the operation time for one time is not wasted and the heat-sealing can be accomplished in a short period of time. In addition, since the extending operation of the nozzle 4 is done automatically, the pressure in the packaging bag 15 can be made uniform. The attachment and removal of the nozzle 4 can be carried out by one snap action, facilitating cleaning or other services, maintenance and so on.

Figure 11:
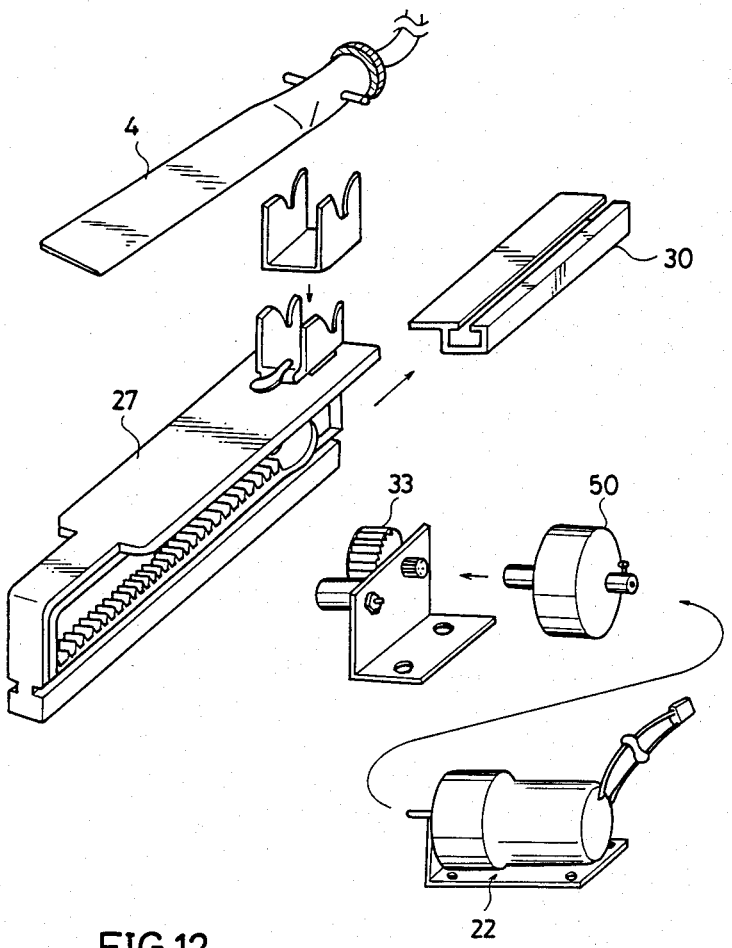
FIG. 11 is an exploded perspective view showing another example of the nozzle mechanism.
Figure 12:
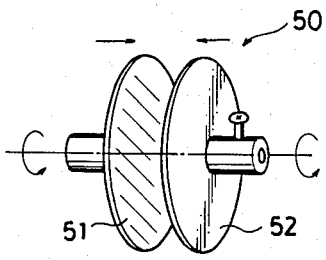
FIG. 12 is an outward perspective view of a torque limitter included in the nozzle mechanism.

FIG. 11 is an exploded perspective view of a nozzle mechanism according to another embodiment of the present invention, and FIG. 12 is an outward perspective view of a torque limitter included in the same nozzle mechanism.

In the embodiment shown in FIGS. 8 to 10C, the nozzle is extended and retracted by the driving power of the motor 22. In the above embodiment, the nozzle 4, the nozzle base 27, the top cover 2 or the like may possibly be broken when the nozzle 4 is extended or retracted, because the nozzle 4 may be pinched between the airtight pressure connection bar 6 or foreign matter may be jammed between the spur gear 33 and the rack 273. Therefore, in this embodiment shown in FIGS. 11 and 12, when an extraordinary torque is exerted on the motor 22, the torque limitter 50 idles the motor 22 in order to protect the nozzle 4 and so on. Namely, a torque limitter 50 is coupled between the motor 22 and the spur gear 33. The torque limitter 50 has a pair of rotary disks 51 and 52 opposing each other and grease or the like is interposed therebetween as shown in FIG. 12, whereby it idles the motor 22 through the disk 52 when an extraordinary torque is exerted on the side of the spur gear 33.

FIG. 13A is a cross sectional view of a hermetic packaging apparatus having an improved strainer and FIG. 13B is a rear view of the main portion thereof.

In the embodiment shown in FIGS. 13A and 13B, after the packaging bag 15 is sucked by the nozzle 4, the nozzle 4 is moved backward and the liquid in the strainer tank 180 is drained. Namely, a drain pipe 261 communicating with the strainer tank 180 is provided on the lower portion of the strainer tank 180 and a cock 230 is attached to penetrate the drain pipe 261. An opening 231 is formed in the cock 230 as will be shown in the following FIG. 14, and, when the opening 231 is pressed in the drain pipe 261, the liquid stored in the strainer tank 180 is discharged to the drain pipe 261. A packing 240 is provided at the portion of the cock 230 penetrating the drain pipe 261 in order to prevent leakage of the liquid. In addition, a coil spring 250 is provided so that when the nozzle 4 is extended forward, the cock 230 is also extended forward.

Figure 14:
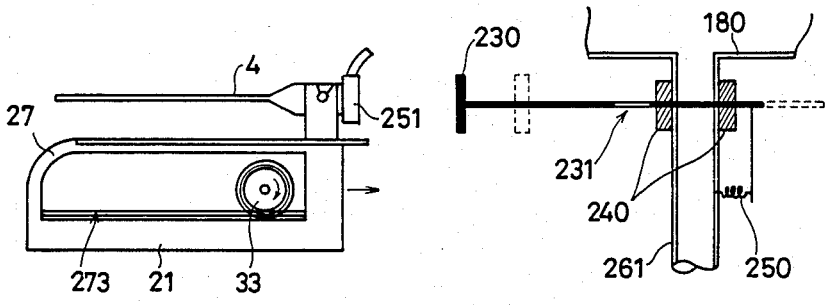
FIGS. 14 and 15 describe the operation of the nozzle and cock.
Figure 15:
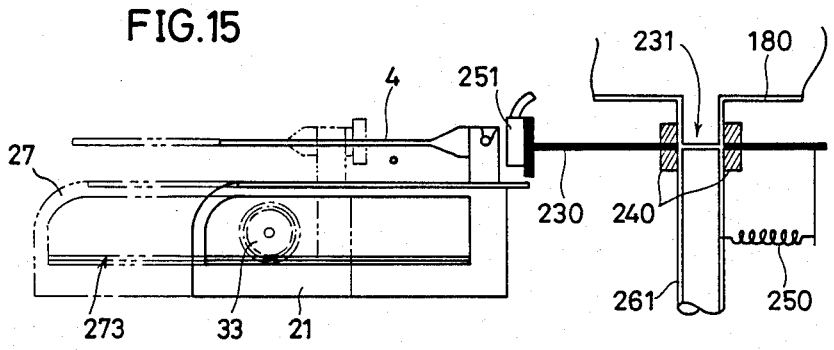

FIGS. 14 and 15 describe the operation of the nozzle and the cock.

Referring to FIG. 14, the packaging bag 15 containing the content 16 is set on the nozzle 4 with the nozzle protruding forward, and the pressure in the packaging bag 15 is reduced. After the pressure is reduced, the motor 22 rotates the spur gear 33 and driving power is transmitted to the rack gear 273 of the nozzle holding base 27 whereby the nozzle 4 as well as the nozzle holding base 27 moves backward. On this occasion, the rear end portion of the nozzle 4 presses the tip portion of the cock 230 provided behind the nozzle, the opening portion 231 of the cock 230 moves into the drain pipe 261 and the liquid temporarily stored in the strainer tank 180 is discharged externally through the drain pipe 261.

As described above, according to the present embodiment, the liquid sucked at the time of reducing pressure in the packaging bag 15 containing the content 16 is temporarily stored in the strainer tank 180 and the stored liquid in the strainer tank 180 is drained outside at every operation by pulling the nozzle 4 back after the completion of reducing pressure to open the cock 230 provided on the lower portion of the strainer tank 180. Therefore, the reduction of pressure and hermetic packaging can be carried out successively even if contents 16 including much water are packed in the packaging bags 15. Meanwhile, since the strainer tank 180 does not store much liquid, the reproduction of various germs can be reduced and, in addition, since no liquid is gathered in the pump or hose, the failure rate can be reduced.

Now, the airtight pressure connecting bar 6 shown in FIG. 4 will be discussed. This bar 6 is formed of a metal arm. Therefore, if an inner pump or the like causes electric leakage, there is a possibility of receiving electrical shock. The present invention made an improvement in the airtight pressure connecting bar against the possible current leakage.

Figure 16:
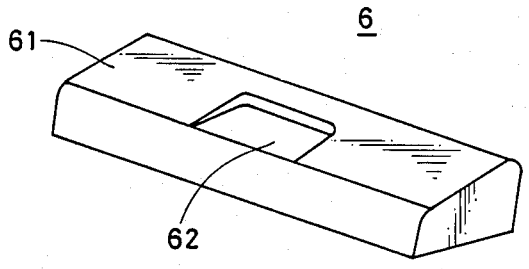
FIG. 16 is an outward perspective view showing an airtight pressure connecting bar.
Figure 17:
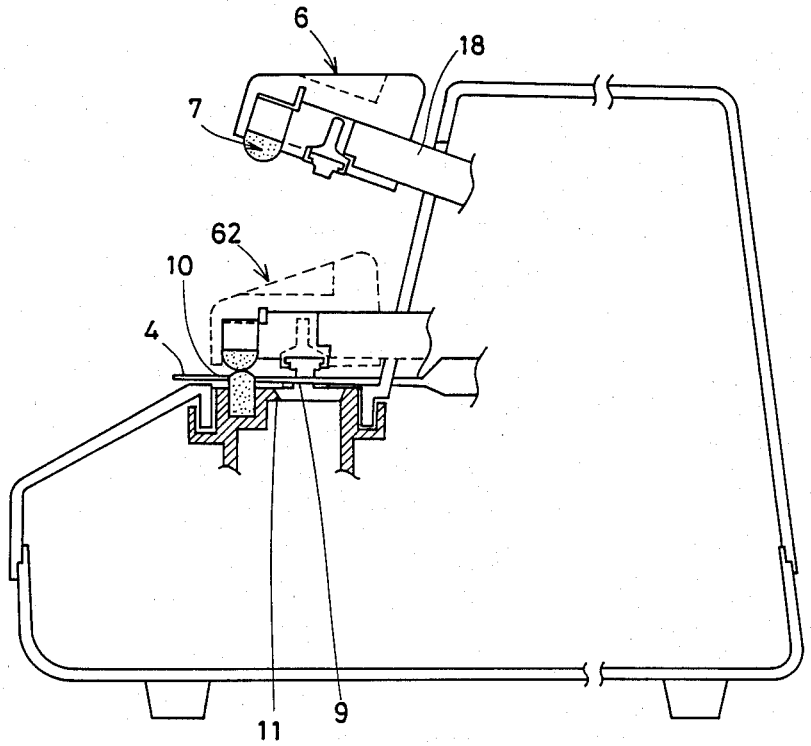
FIG. 17 is a cross sectional view of a main portion of the pressurizing portion.

FIG. 16 is an outward perspective view of the airtight pressure connecting bar and FIG. 17 is a cross sectional view of the main portion of the pressurizing portion.

As shown in FIG. 16, the airtight pressure connecting bar 6 is covered with a resin cover 61 and a flat portion 62 having different inclinations is formed in the central portion of the front side of the resin cover 61. The pressurizing operation is performed by manually operating the flat portion 62. By covering the airtight pressure connecting bar 6 by a resin cover 61 and by forming a flat portion 62, there is no danger of current leakage. As shown in FIG. 17, in heat-sealing by pushing the airtight pressure connecting bar 6, the hand of the operator does not slip. Namely, this serves as a stopper of slipping. In addition, in operating the airtight pressure connection bar 6, the packaging bag 15 is uniformly pressurized by operating the flat portion 62, so that the misoperation such as pressing one end of the airtight pressure connecting bar 6 can be prevented.

In the conventional hermetic packaging apparatus, an air pump 25 for exhausting the packaging bag 15 by the nozzle 4 is entirely covered with a cushion for preventing vibration is provided between the top cover 2 and the bottom cover 17 and not fixed to the body. Furthermore, the sucking hole and exhausting hole are provided juxtaposed side by side. The sucking hole is connected to the sucking pipe and the exhausting hole is connected to exhausting pipe. The sucking pipe is connected to the nozzle and the exhausting pipe is directed outside of the body. Therefore, if the content in the packaging bag 15 includes water, water as well as air is exhausted, so that there is a possibility that some water remains in the exhausting pipe. In this embodiment of the present invention, an improvement is made in order to prevent the water from remaining in the exhausting pipe.

Figure 18:
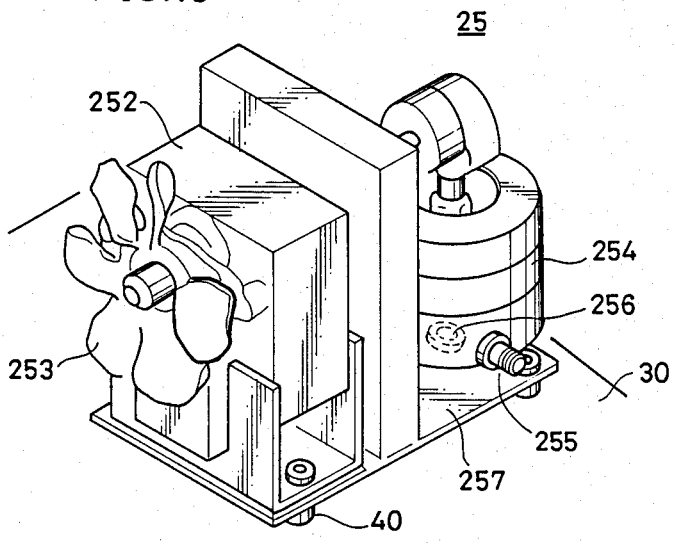
FIG. 18 is an outward perspective view showing the attachment structure of an air pump.

FIG. 18 is an outward perspective view showing the attachment structure of the air pump.

The air pump 25 is structured as shown in FIG. 18. Namely, a cooling fan 253 is fixed to the rotary access of the shaded pole motor 252. The rotary axis of the shaded pole motor 252 is coupled to the pump 254. A sucking hole 255 is formed in the lower portion of the side surface of the pump 254 while an exhausting hole 256 is formed on the bottom surface of the pump 254. The shaded pole motor 252 and a pump 254 are attached to the base plate 257 and a rubber member 40 is provided for avoiding vibration. This member 40 is located between the base plate 257 and the metal base plate 1. Although not shown, an exhaust dispersing agent is provided between the exhausting hole 26 and the bottom cover 17. The exhaust dispersing agent is formed detachably.

As described above, since a the rubber member 40 prevents vibration and is provided between the base plate 257 and a metal base plate 1 and both are fixed together with screws, the base plate 257 is made stable and the noise or vibration can be fairly depressed when compared with the conventional apparatus. In addition, since an exhausting hole 256 is provided on the bottom surface of the pump 254, direct exhaust to the outside of the body can be carried out without providing a connection pipe. Therefore, there is no possibility of water remaining in the exhausting pipe, as in the conventional apparatus, so that the performance of the pump or other electric units is not damaged. In addition, since an exhaust dispersing agent is provided between the exhausting hole 255 and the bottom cover 17, the exhausting noise can be softened.

Figure 1:
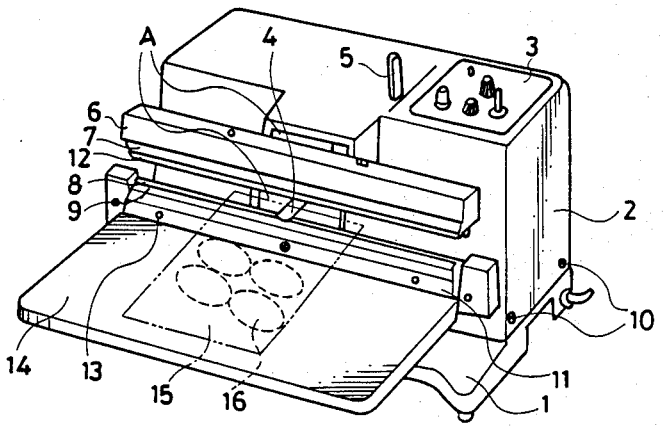
FIG.1 PRIOR ART
FIG. 1 is an outward perspective view of a conventional hermetic packaging apparatus.
Figure 2:
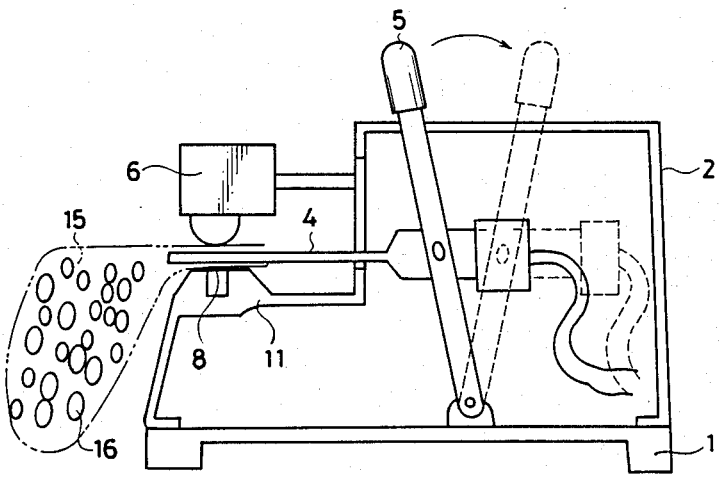
FIG.2 PRIOR ART
FIG. 2 is a cross sectional view of a conventional hermetic packaging apparatus.
Figure 19A:
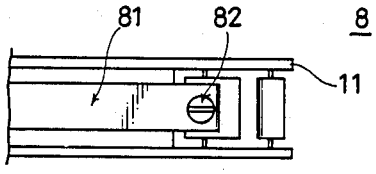
FIG.19A PRIOR ART
FIG. 19A is a plan view showing the structure of the heating element shown in FIG. 1
Figure 19B:
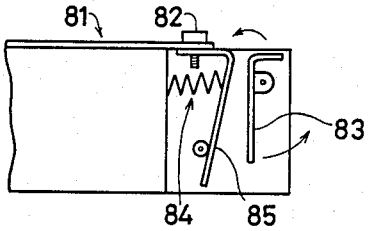
FIG.19B PRIOR ART
FIG. 19B is a front view thereof.
Figure 19B:
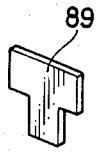
FIG.19B PRIOR ART

FIG. 19A is a plan view showing the structure of a conventional heating material shown in FIG. 1 and FIG. 19B is a front view of the same.

In FIG. 19A, the heating material 8 comprises a sealing heater 81 and the sealing heater 81 is fixed by screws to the heater mounting metal fittings by the heater mounting screw 82. A tension spring 84 is provided between the heater mounting metal fittings 85 and the sealing base 11. A lever 83 is provided opposed to the heater mounting metal fitting 85. In order to inspect and exchange the sealing heater 81 in the heating material 8 structured as above, a heater cover, not shown, is removed so that the sealing heater 81 can be seen. Then, the lever 83 is turned counterclockwise as shown by the arrow, the heater setting metal fitting 85 is pressed to compress the tension spring 84. The tension of the sealing heater 81 is loosened, the heater fitting screw 82 is removed and the seal heater 81 is exchanged. As is apparent from the foregoing, the sealing heater 81 is not easily exchanged. Namely, in order to exchange the sealing heater 81, the heater cover is removed, the level 83 is operated and thereafter the heater fitting screw 82 is loosened. In the embodiment of the present invention, an improvement is made to carry out the exchange of the sealing heater 81 easily.

Figure 20A:
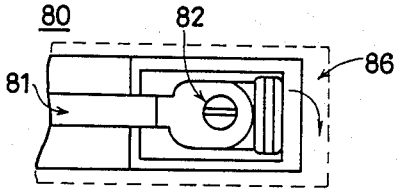
FIG. 20A is a plan view showing the attachment structure of the heating element according to one embodiment of the present invention and FIG. 20B is a front view thereof.
Figure 21:
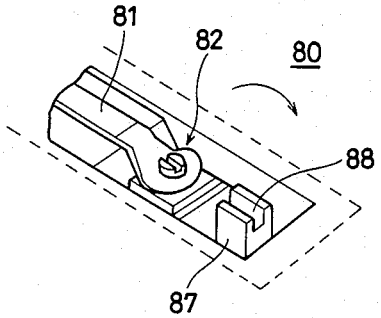
FIG. 21 describes the operation for releasing the tension of the seal heater.
Figure 20B:
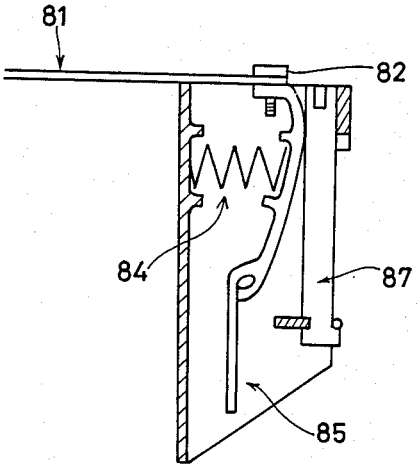

FIG. 20A is a plan view showing the attachment structure of the heating material 80 and FIG. 20B is a front view of the same. FIG. 21 describes the operation of loosening the tension of the sealing heater.

Referring to FIG. 20A, the sealing heater 81 is fixed to the heater mounting metal fitting 85 by the heater fitting screw 82, as is the same as in the case of FIGS. 19A and 19B. A tension spring 84 is provided between the heater mounting metal fitting 85 and sealing base 11 and tension is exerted to the sealing heater 81 by the tension spring 84. In this embodiment, a heater fixing element 87 is provided such that it abuts against the heater mounting metal fitting 85. The heater fitting element 87 has a rectangular cross section and a trench 88 is formed in the upper portion thereof. The longer side of the heater fitting element 87 abuts the heater mounting metal fitting 85. A Teflon tape 86 is arranged to cover the sealing heater 81, heater fixing screw 82 and the heater fitting element 87.

In exchanging the sealing heater 81 in the heating material 80 structured as above, the Teflon tape 86 is peeled away, a rotary tool 89 is inserted in the trench 88 of the heater fitting element 87 and the rotary tool 89 is turned by 90° in the clockwise direction in FIG. 21. Then, the short side of the heater fitting element abuts on the heater mounting metal fitting 85 to compress the tension spring 84. As a result, the tension over the sealing heater 81 is loosened. Then, the heater fitting screw 82 is loosened to remove the sealing heater 81.

As described above, in this embodiment, the tension over the sealing heater 81 exerted by the tension spring 84 can be loosened only by removing the Teflon tape 86 and by turning the heater fixing element 87 90°. Therefore, a plurality of operations such as removing heater mounting cover, operation of lever 83 and so on in the conventional apparatus can be eliminated, enabling easy exchange and inspection of the sealing heater 81.

Figure 22:
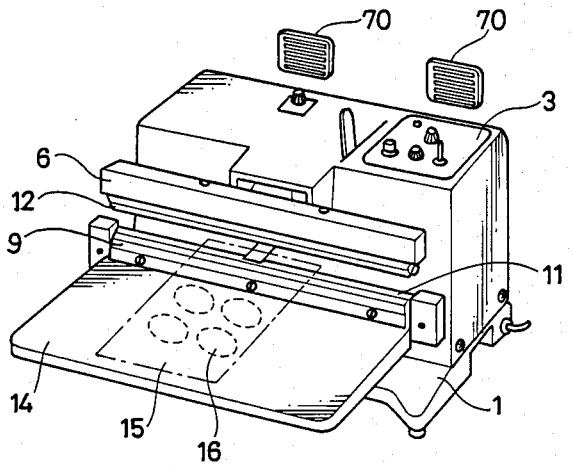
FIG.22 PRIOR ART
FIG. 22 shows the structure of ventilating panels in a conventional hermetic packaging apparatus shown in FIG. 1.
Figure 23:
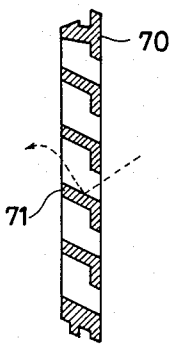
FIG.23 PRIOR ART
FIG. 23 shows a cross sectional structure of the ventilating panels shown in FIG. 22.

FIG. 22 shows the structure of a ventilating panel of a conventional hermetic packaging apparatus shown in FIG. 1 and FIG. 23 shows a cross sectional structure of the ventilating panel.

Since a conventional hermetic packaging apparatus is used in watery places such as a kitchen and the contents 16 often include water, a water proof structure is needed. However, if the entire body is perfectly sealed to be water proof, the heat generated from the pump or transformer for operating the heater contained in the apparatus cannot be dissipated. Therefore, a ventilating panel 70 having a plurality of slits in the rear side is provided, as shown in FIG. 22. However, the ventilating panel 70 only has collars 71 extending diagonally upward from the lower side of the slit into the apparatus. Therefore, if the water attaches or drops along the side surface or rear surface of the hermetic packaging apparatus, it can prevent the entrance of water into the apparatus, however, if water drops directly to the collar 71 as shown by the dotted line in FIG. 23, the water springs back on the collar 71 and the entrance of the water into the apparatus can not be prevented. As a result, bad influences are exerted on the inner parts, specifically electric parts, causing a degradation in function or, in the worst case, stoppage function. Therefore, in this embodiment, an improvement is made to prevent the water drop from entering the apparatus.

Figure 24:
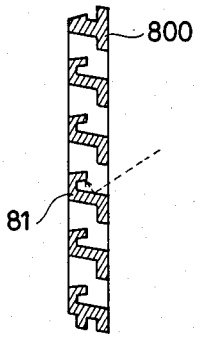
FIG. 24 is a cross sectional view showing an improved ventilating panel.

FIG. 24 is a cross sectional view showing the improved ventilating panel. In FIG. 24, a plurality of slits are formed in the ventilating panel 800 and collars 81 are formed to extend diagonally upward from the lower parts of the slits, with the tip ends of the collars 81 hooked. Therefore, if water enters as shown by the dotted line in FIG. 24, the water drop hits the hooked portion and thus, the entrance of water into the apparatus can be prevented. Such a ventilating panel 800 can be easily formed by resin molding, so that it does not increase costs compared with the conventional ventilating panel 70 shown in FIG. 23.

Figure 25:
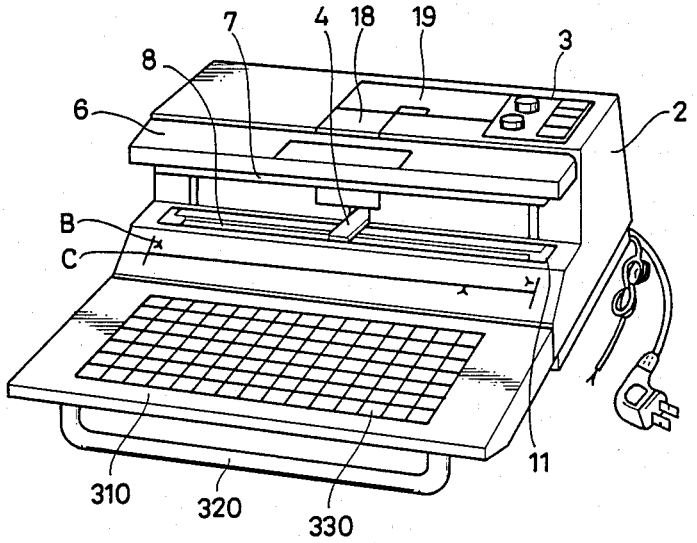
FIG. 25 is an outward perspective view of a hermetic packaging apparatus provided with an improved working table.

FIG. 25 is an outward perspective view of the hermetic packaging apparatus with an improved working table attached thereto.

In FIG. 25, a working table 310 is provided in front of the top cover 2 and fore-leg 320 is pivotably provided below the working table 310. By raising and lowering the fore-leg 320, the working table 310 can be inclined. On the top surface of the working table 310, scales 330 are marked and heat-sealing can be carried out with reference to the scales 330.

Figure 26:
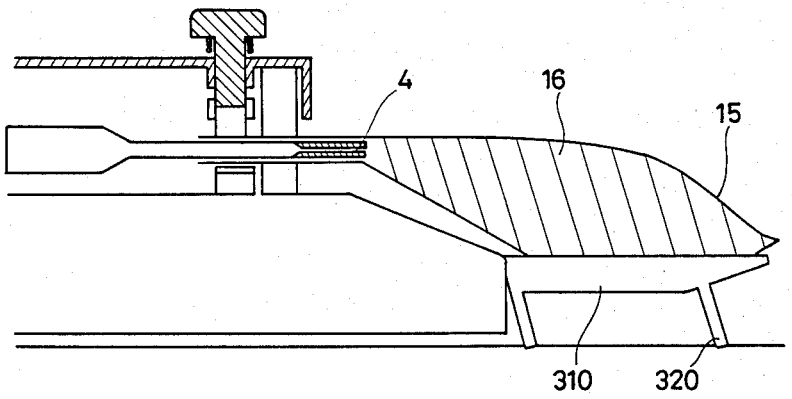
FIGS. 26 and 27 are cross sectional views of main portions showing the packaging of the contents in a packaging bag according to one embodiment of the present invention.
Figure 27:
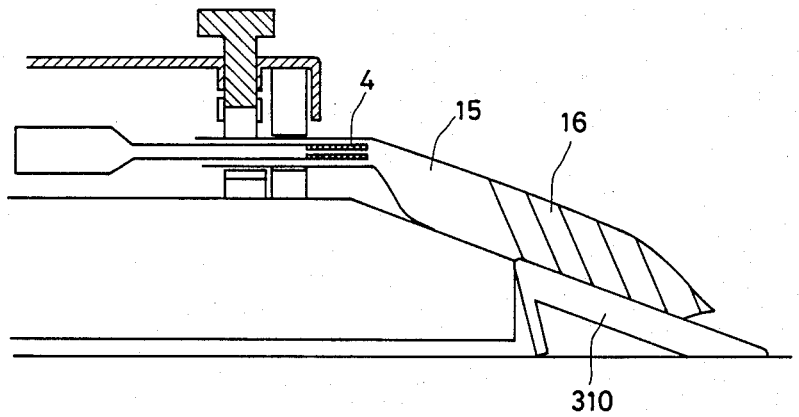

FIGS. 26 and 27 are cross sectional views of main portions describing the packaging of contents in the packaging bag.

Referring to FIG. 26, by setting up the fore-leg 320 of the working table 310, the upper surface of the working table 310 becomes even and when contents 16 in the packaging bag 15 are heat-sealed, the contents 16 are made level so that suction by the nozzle 4 is carried out easily.

As shown in FIG. 27, by folding the fore-leg 320 of the working table 310, the upper surface of the working table 310 inclines and when contents including water in the packaging bag 15 are heat-sealed, the water flows backward in the packaging bag 15 so that the nozzle 4 does not suck water.

Figure 28:
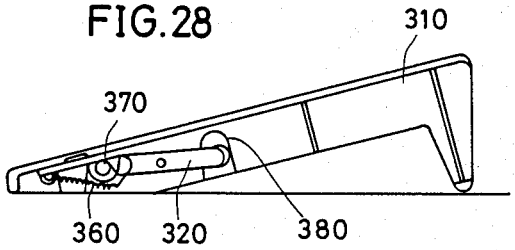
FIGS. 28 and 29 are cross sectional views showing the practical structure of the working table according to one embodiment of the present invention.
Figure 29:
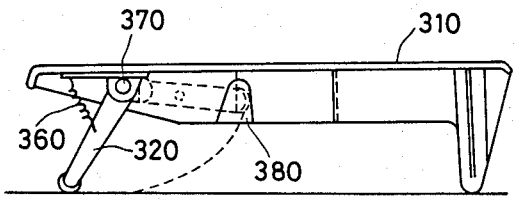

FIGS. 28 and 29 are side views showing a practical structure of the working table according to one embodiment of the present invention.

Referring to FIG. 28, a fore-leg 320 is provided on the working table 310 pivotably around the fulcrum 370. The fore-leg 320 is coupled by a spring 360 provided between the front portion of the working table 310. When the fore-leg 320 is set up, the fore-leg is pulled forward by the spring 360. When the fore-leg 320 is folded, the tip end portion of the fore-leg 320 is stored in the notch formed in the lower part of the working table 310.

As described above, according to the present invention, since the fore-leg 320 of the working table 310 is collapsibly structured, the height of the working table 310 can be adjusted in two steps, so that when the fore-leg 320 is set up the working table 310 becomes flat and when the fore-leg 320 is folded the working table inclines. Therefore, when foods containing little water such as sweets, dry goods or tea are to be packed, the fore-leg 320 is set up to make the working table 310 flat whereby the contents 16 are made level. When foods containing a lot of water are packed, the fore-leg 320 is folded to make the working table 310 inclined, whereby the water in the contents flows backward in the packaging bag, eliminating the possibility in water being sucked by the nozzle 4.

In the hermetic packaging apparatus shown in FIG. 4, the sealing base 11 is structured such that a metal plate is laid on the position of the sealing mechanism of the body and a heating wire is arranged thereon with an insulating material interposed therebetween. Therefore, heat dissipation is insufficient at the heating portion and, in addition, the thermister for adjusting heating time can not accurately detect the heater temperature. Therefore, when the heat-sealing is carried out successively, there is a possibility that the sealing of the packaging bag becomes imperfect. Therefore, in another embodiment of the present invention, the sealing base structured in a separate unit from the body is employed.

Figure 30:
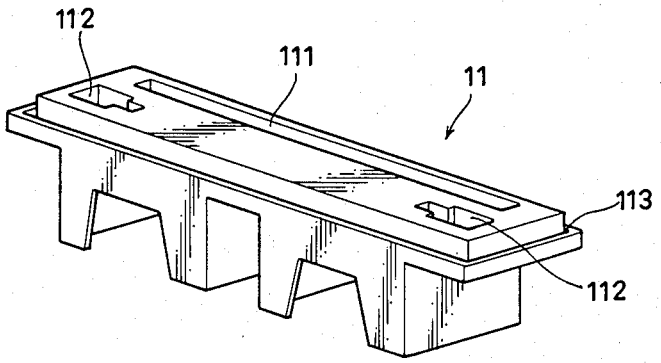
FIG. 30 is an outward perspective view of a sealing base viewed from above.
Figure 31:
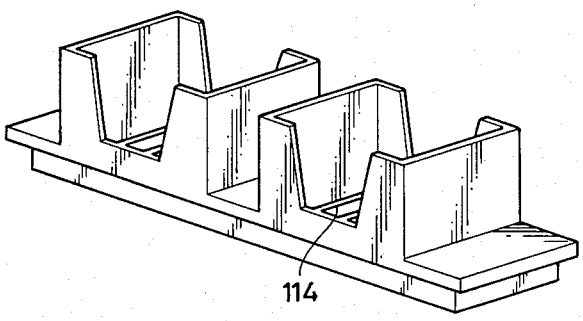
FIG. 31 is an outward perspective view of the sealing base viewed from the lower side.
Figure 32:
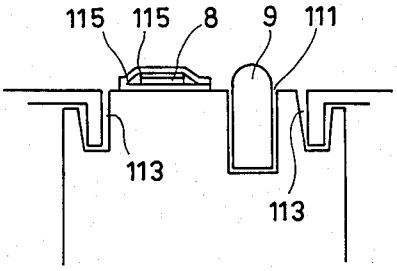
FIG. 32 is a cross sectional view of a main portion of the sealing base.

FIG. 30 is an outward perspective view of the sealing base viewed from the upper surface thereof, FIG. 31 is an outward perspective view of the same viewed from the lower side thereof and FIG. 32 is a cross sectional view of the main portion of the sealing base.

The sealing base 11 is structured as a separate unit as shown in FIGS. 30 and 31. Namely, the sealing base 11 is integratedly formed by metal and a trench 111 for receiving airtight packing 9 is formed on the upper surface thereof as shown in FIG. 32 and holes 112 are formed at both ends of the upper surface. These holes are to retain the holding metal fittings of the heating material 8. A trench 113, to which the top cover 2 fits, is formed around the sealing base 11 and a reinforcing member 114, which is also used for heat dissipation, is formed in the lower part of the sealing base 11. An insulating material 115 in which a heating material 8 is contained, is arranged on the sealing base 11.

Figure 33A:
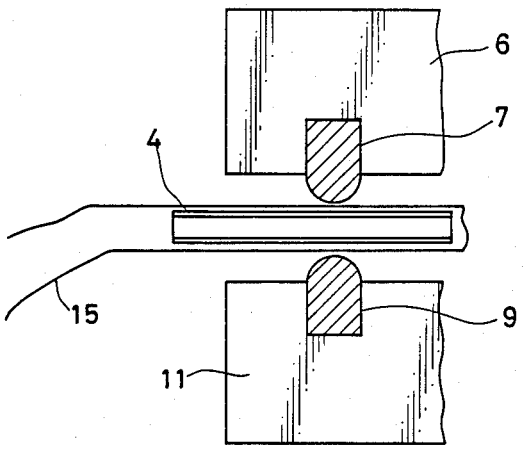
FIG.33A PRIOR ART
FIGS. 33A and 33B are cross sectional views showing a main portion of an airtight packing attached to the sealing base shown in FIG. 1.
Figure 33B:
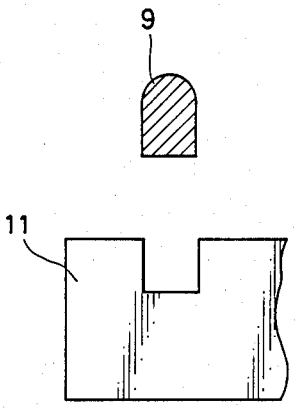
FIG.33B PRIOR ART
Figure 34A:
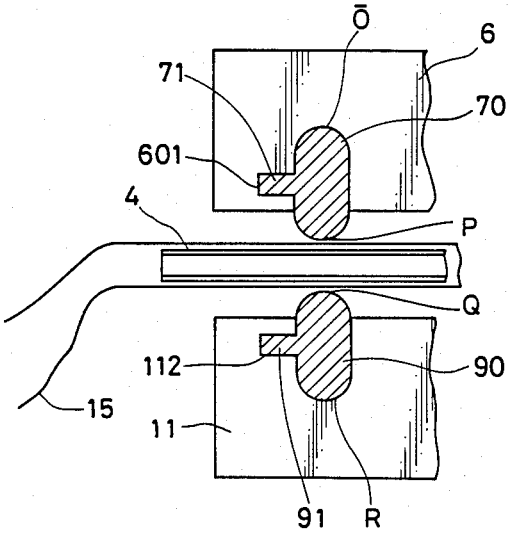
FIGS. 34A and 34B are cross sectional views of a main portion of the sealing base according to one embodiment of the present invention.
Figure 34B:
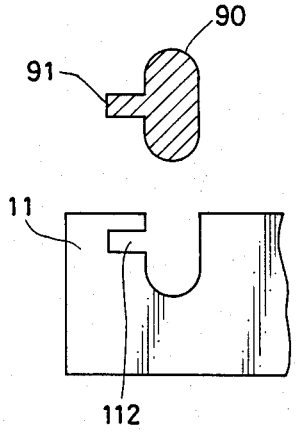

FIGS. 33A and 33B are cross sectional views of main portions of the airtight packing attached to the sealing base shown in FIG. 1 and FIGS. 34A and 34B are cross sectional views of the main portions of the sealing base according to a further embodiment of the present invention.

In the conventional hermetic packaging apparatus shown in FIG. 1, the airtight packings are only fitted in the trenches formed in the sealing base 11 and in the airtight pressure connecting bar 6, so that when the nozzle 4 is retracted, the airtight packings 7 and 9 can be turned up by friction. Therefore, in the embodiment of the present invention, airtight packings 70 and 90 have oval cross sections and projecting ribs 71 and 91 extend along the longitudinal direction, as shown in FIGS. 34A and 34B. Trenches 112 and 601 are formed in the sealing base 11 and in the airtight pressure connecting bar 6 for the projecting ribs 71 and 91 of the airtight packings 70 and 90 are fitted thereto. These airtight packings 70 and 90 are formed of foaming silicone rubber. By thus forming the projection ribs 71 and 91 in the airtight packings 70 and 90, when the nozzle 4 is retracted into the body side, the projecting ribs 71 and 91 of the airtight packings 70 and 90 are caught by the trench 112 of the sealing base 11 and the trench 601 of the airtight pressure connecting bar 6, eliminating the possibility of turning up.

In addition, in the present invention, the top and bottom of each of the airtight packagings 70 and 90 are formed symmetrically. Therefore, if the P and Q surfaces of the airtight packings 70 and 90 are damaged or degraded through long use to lose their function, the airtight packagings 70 and 90 can be reattached with the surfaces $\overline{O}$ and R opposed to each other to retrieve the function.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A hermetic packaging apparatus in which an opening portion of a thermoplastic packaging bag containing contents is heat-sealed, comprising:

a nozzle for at least one of reducing, increasing and maintaining pressure within said packaging bag;

pressure control means connected to said nozzle for controlling pressure within said packaging bag to control at least one of reducing the pressure, increasing the pressure and keeping a prescribed gas pressure in said packaging bag;

heat-sealing means for applying heat to the opening portion of said packaging bag with one of the pressure reduced, the pressure increased and the pressure kept at a prescribed gas pressure for heat-sealing;

a metal base on which said nozzle, said pressure control means and said heating means are attached;

a resin cover covering at least said pressure control means and constituting an outer casing; and waste water storage means for storing liquid sucked from the contents of said packaging bag when the pressure in said packaging bag is reduced by said nozzle.

2. The hermetic packaging apparatus according to claim 1, which further comprises:

nozzle holding means provided on said metal base and movable in forward and backward directions for holding said nozzle; and nozzle driving means for moving said nozzle holding means in the forward and backward directions in response to an external instruction.

3. The hermetic packaging apparatus according to claim 2, wherein said driving means comprises:

a motor which rotates in at least one of the forward direction and in the backward direction in response to the external instruction; and a gear member for moving said nozzle holding means in the forward and backward directions in response to the rotation of said motor.

4. The hermetic packaging apparatus according to claim 1, wherein said nozzle comprises a flat portion in which a tip end is formed flat.

5. The hermetic packaging apparatus according to claim 1, which further comprises waste water drain means for draining stored waste water in said waste water storage means after said packaging bag is sucked by said nozzle in response to the backward movement of said nozzle driven by said nozzle drive means.

6. The hermetic packaging apparatus according to claim 1, wherein said heat-sealing means comprises:

heating means for heating the opening portion of said packaging bag;

a sealing base for holding said heat-sealing means; and pressurizing means for pressing the opening portion of said packaging bag disposed on said heating means to seal the same.

7. The hermetic packaging apparatus according to claim 6, wherein said sealing means comprises a first airtight packing provided in a rear side of said heating means, and said pressurizing means comprises a second airtight packing provided opposed to said first airtight packing in a lower portion thereof.

8. The hermetic packaging apparatus according to claim 1, which further comprises a working table provided detachably in a front portion of said metal base and on which said packaging bag is placed.

9. The hermetic packaging apparatus according to claim 8, wherein said working table comprises:

a rear leg provided on said metal base side; and a collapsible fore-leg spaced apart by a prescribed distance from said rear leg.

10. A hermetic packaging apparatus for heat-sealing an opening portion of a thermoplastic package containing contents, comprising:

a nozzle having a flat tip and for at least one of reducing pressure, increasing pressure and filling said packaging bag with gas;

nozzle holding means movable in forward and backward directions for holding said nozzle;

nozzle driving means for moving said nozzle holding means in the forward and backward directions in response to an external instruction;

pressure control means coupled to said nozzle for controlling pressure so that the pressure in said packaging bag is one of reduced, increased and held constant;

waste water storage means coupled to said nozzle for storing liquid sucked from the contents in said packaging bag when the pressure of said packaging bag is reduced by said nozzle;

a sealing base provided below said nozzle and extending in a direction orthogonal to said nozzle;

heating means for heating the opening portion of said packaging bag placed on said sealing base; and pressuring means for pressing said opening portion of the packaging bag heated by said heating means from above to heat-seal the opening portion of the packaging bag.

11. A hermetic packaging apparatus in which an opening portion of a thermoplastic packaging bag containing contents is heat-sealed, comprising:

a nozzle for at least one of reducing, increasing and maintaining pressure within said packaging bag;

pressure control means connected to said nozzle for controlling pressure within said packaging bag to control at least one of reducing the pressure, increasing the pressure and keeping a prescribed gas pressure in said packaging bag;

heat-sealing means for applying heat to the opening portion of said packaging bag in which the pressure has been one of reduced, increased and kept constant for heat-sealing;

a metal base on which said nozzle, said pressure control means and said heating means are attached;

nozzle holding means provided on said metal base and movable in forward and backward directions for holding said nozzle; and nozzle driving means for moving said nozzle holding means in the forward and backward directions in response to an external instruction, said nozzle driving means comprising;

a motor which rotates in at least one of the forward and backward directions in response to the external instruction, a gear member for moving said nozzle holding means in the forward and backward directions in response to the rotation of said motor, and a torque limiter coupled between said motor and said gear member for idling said motor when a load larger than a prescribed level is applied for the forward and backward moving of said nozzle holding means.

12. The hermetic packaging apparatus according to claim 11, further comprising a resin cover covering at least said pressure control means and constituting an outer casing.

13. The hermetic packaging apparatus according to claim 11, wherein said nozzle comprises a flat portion in which a top end is formed flat.

14. The hermetic packaging apparatus according to claim 11, wherein said heat-sealing means comprises:

heating means for heating the opening portion of said packaging bag;

a sealing base for holding said heat-sealing means; and pressurizing means for pressing the opening portion of said packaging bag disposed on said heating means to seal the opening portion.

15. The hermetic packaging apparatus according to claim 14, wherein said sealing means comprises a first airtight packing provided in a rear side of said heating means, and said pressurizing means comprises a second airtight packing provided opposed to said first airtight packing in a lower thereof.

16. The hermetic packaging apparatus according to claim 11, which further comprises a working table provided detachably in a front portion of said metal base and on which said packaging bag is placed.

17. The hermetic packaging apparatus according to claim 16, wherein said working table comprises:

a rear leg provided on said metal base side; and a collapsible fore-leg spaced apart from said rear leg by a prescribed distance.

* * * * *